United States Patent [19]

Powell

[11] Patent Number: 4,989,742

[45] Date of Patent: Feb. 5, 1991

[54] TRAY APPARATUS

[76] Inventor: Earl A. Powell, 509 SW. Elm, Ankeny, Iowa 50021

[21] Appl. No.: 434,767

[22] Filed: Nov. 13, 1989

Related U.S. Application Data

[63] Continuation-in-part of Ser. No. 206,671, Jun. 15, 1988, abandoned.

[51] Int. Cl.[5] ..... B65D 21/02

[52] U.S. Cl. ..... 220/23.4; 206/549; 220/23.83; 220/85 H

[58] Field of Search ..... 220/23.86, 85 H, 23.83, 220/23.4, 23.6, 23.8; 206/549, 217, 558, 560, 565, 541, 562, 563; 294/144, 145, 172, 27.1, 29, 32

[56] References Cited

U.S. PATENT DOCUMENTS

| | | | |
|---|---|---|---|
| 2,997,199 | 5/1957 | Reachi | 220/23.86 |
| 3,148,636 | 9/1964 | Bloomquist | D7/38 |
| 3,219,226 | 11/1965 | Schroeder | 220/23.83 |
| 3,894,649 | 7/1975 | Nicholl | 220/23.83 |
| 3,964,629 | 6/1976 | McCabe | 220/23.86 |
| 4,534,474 | 8/1985 | Ng | 220/23.86 |
| 4,607,758 | 8/1986 | Stevens | 220/23.83 |
| 4,785,959 | 11/1988 | Kleiner | 220/23.86 |

FOREIGN PATENT DOCUMENTS

| | | | |
|---|---|---|---|
| 1252761 | 5/1969 | United Kingdom | 220/23.86 |

*Primary Examiner*—Joseph Man-Fu Moy
*Attorney, Agent, or Firm*—H. Gordon Shields

[57] ABSTRACT

Tray apparatus includes a base tray having two compartments separated from each other by a hand hold portion. The two compartments each receive additional tray elements. One compartment is small, and is used to receive a beverage container of some type, and the other compartment is large and may be used for receiving food elements directly or for receiving alternate types of tray elements, depending on the type of food being served. The tray elements include cooperative locking structures.

30 Claims, 3 Drawing Sheets

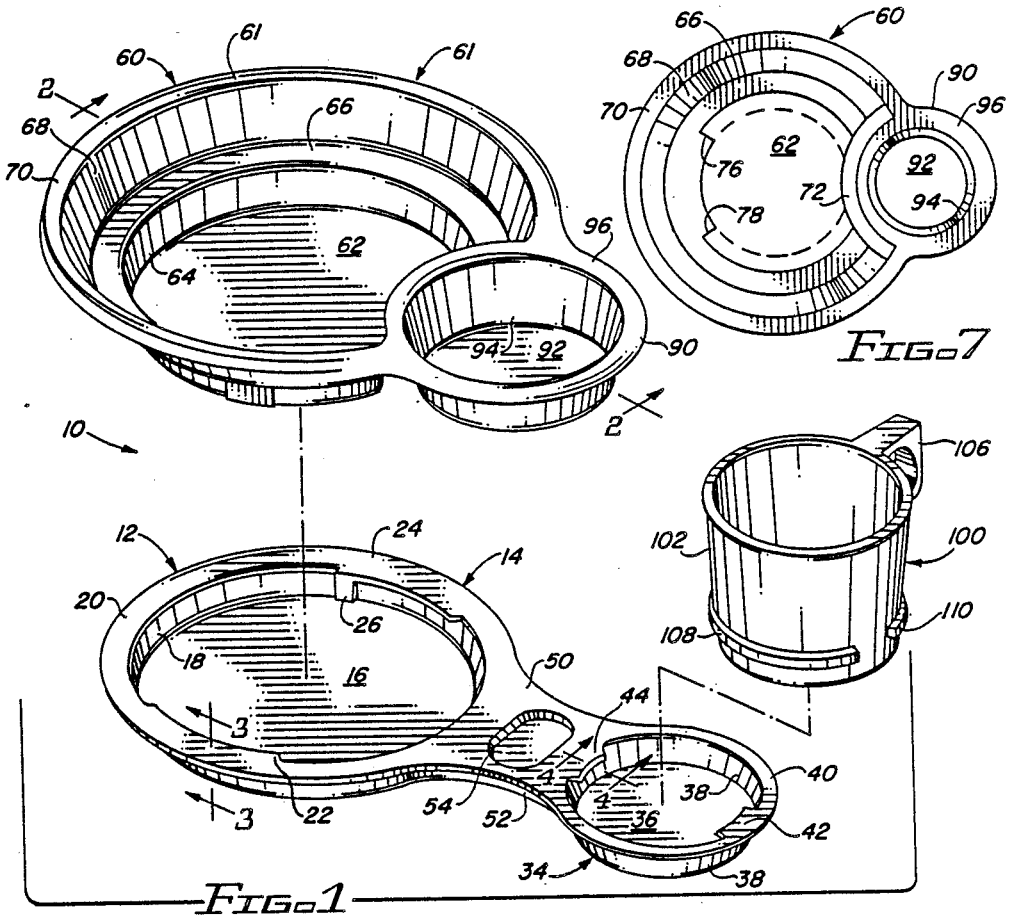
FIG. 7
FIG. 1
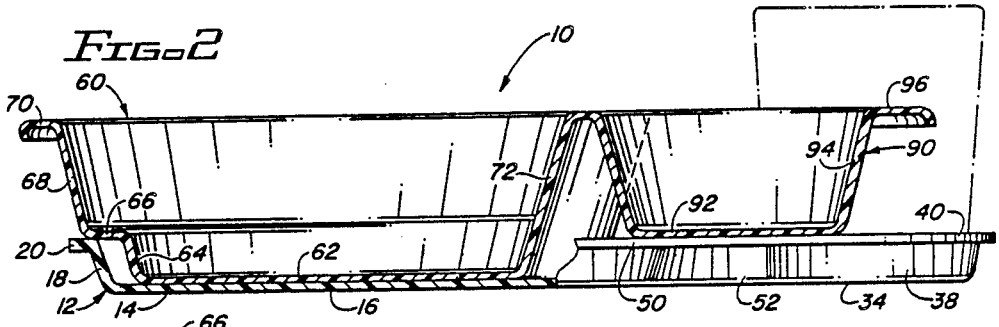
FIG. 2
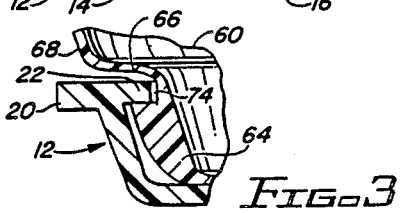
FIG. 3
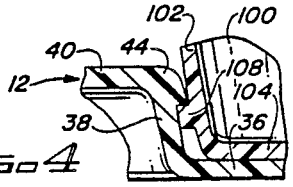
FIG. 4

TRAY APPARATUS

CROSS-REFERENCE TO RELATED APPLICATION

This application is a continuation-in-part application of copending application Ser. No. 07/206,671, filed June 15, 1988, and now abandoned.

BACKGROUND OF THE INVENTION

1. Field of the Invention

This invention relates to tray apparatus, and more particularly, to tray apparatus having a plurality of compartments separated by a hand hold portion and includes additional tray components.

2. Description of the Prior Art

Various designs have been developed over the years for tray apparatus. In the following paragraphs, various patents are discussed. The patents are described in two separate categories, one category for design patents and one category for utility patents.

The following thirteen United States patents are all design patents. The drawing Figures disclose various embodiments of compartmented serving trays for food items and/or beverage items. It will be noted that all of the patents are single element patents. That is, while the patents may include several compartments, and some of the compartments may be designed specifically to receive beverage containers or the like, the trays themselves are unitary elements, unlike the apparatus of the present invention. The apparatus of the present invention includes several elements, and which elements may be selectively used with a base element.

The thirteen design patents are as follows:

| | | |
|---|---|---|
| Des. 145,764 | V. Zelov | Oct. 15, 1946 |
| Des. 148,419 | C. Jacobsen | Jan. 20, 1948 |
| Des. 177,073 | R. Smith | March 6, 1956 |
| Des. 199,991 | C. McManamey | Jan. 5, 1965 |
| Des. 200,654 | A. Scott | March 23, 1965 |
| Des. 218,351 | S. Nestegard et al | Aug. 11, 1970 |
| Des. 214,641 | I. Malakoff | July 8, 1969 |
| Des. 227,851 | F. Nowland et al | July 24, 1973 |
| Des. 251,102 | T. Box | Feb. 20, 1979 |
| Des. 255,968 | D. Shack | July 22, 1980 |
| Des. 270,506 | G. Thorne | Sept. 13, 1983 |
| Des. 278,015 | L. Lasco | March 19, 1985 |
| Des. 291,957 | K. Stevens | Sept. 22, 1987 |

The following utility patents are discussed in individual paragraphs.

U.S. Pat. No. 951,114 (Clark et al.) discloses a tray which includes two portions secured together to define a complete tray. The tray includes a double bottom, with finger apertures extending through the false bottom portion of the double bottom which allow the tray to be carried and easily balanced by a single hand.

U.S. Pat. No. 1,565,952 (Phillips) discloses an ice cream cone server tray which includes a flat portion and a stand portion. The stand portion is secured to the flat portion and extends downwardly from it. The flat portion includes a handle at one end for carrying. The flat portion also includes a plurality of apertures which receive ice cream cones.

U.S. Pat. No. 1,778,425 (Maddocks et al.) discloses another type of ice cream cone carrier. The ice cream cone carrier includes a flat handle and a pair of outwardly extending flanges, and apertures extending through the flanges receive ice cream cones. A number of the carriers may be secured together to carry more than two cones.

U.S. Pat. No. 1,885,483 (Samuelson) discloses an elliptically shaped tray with depressions for receiving various items or articles. The apparatus also includes slots for receiving eating utensils.

U.S. Pat. No. 1,953,933 (Gundelach) discloses a circular tray having an outer rim. The tray portion includes a slot through which the thumb of a user extends. The tray is gripped from below by a user's fingers and from above by the thumb extending through the aperture.

U.S. Pat. No. 2,302,446 (Kincaid) discloses a multiple level buffet tray having a pair of beverage receptacles at opposite ends of a tray and a hand extending arcuately from end to end.

U.S. Pat. No. 2,533,997 (Cochrane) discloses a cup carrying tray. Cutout apertures in the tray receive cups. The cutout portion of two of the apertures fold up to comprise a carrying handle for the tray apparatus.

U.S. Pat. No. 2,808,191 (Cramer) discloses a tray designed to fit onto a user's lap. The tray includes a bottom portion and an upper portion. Apertures through the upper portion receive plates, beverage containers, etc. The bottom portion of the tray slopes to conform to the anatomy of a user's lap so that the top portion will remain relatively flat. The apparatus is made from a single blank, and is folded appropriately to comprise the tray apparatus.

U.S. Pat. No. 2,997,199 (Reachi) discloses a table ornament and standard. The apparatus includes a base with a central holding element extending upwardly from the base. The holding element includes fastener elements for securing the bottom of a candle holder to the base. The fastening systems include a threaded engagement between the candle holder and the base and a groove on the candle holder which mates with dimples in the base.

U.S. Pat. No. 3,142,425 (Cobb) discloses a cup, cone, or similar holder having a flat top and a pistol type holder grip. The top includes apertures for receiving cups, ice cream cones, or the like.

U.S. Pat. No. 3,148,636 (Bloomquist et al) discloses a serving tray designed to be set or disposed on a flat surface. The tray apparatus is not designed to be held by the hand of a user. The tray apparatus includes a platform spaced upwardly from the surface on which it is disposed by downwardly depending walls. On the platform is a plurality of apertures or compartments which receive various elements such as plates, cups, utensils, and the like.

U.S. Pat. No. 3,219,226 (Schroeder) discloses a food serving device which includes a relatively large serving bowl with a smaller serving bowl detachably mounted to the relatively large serving bowl. The smaller serving bowl includes a groove extending upwardly from its bottom which allows the smaller serving bowl to be disposed on the upper portion of the wall of the relatively large serving bowl. The groove essentially comprises a notch which mates with the wall of the large serving bowl to hold the small serving bowl in place.

U.S. Pat. No. 3,804,031 (Pitts) discloses a tray designed for use in an automobile having bucket front seats and a back seat. The apparatus is designed to extend between the back seat and the front seat, and to be supported on the back seat and on the center front arm rest.

U.S. Pat. No. 3,894,649 (Nicholl) discloses a tray apparatus designed to be used by a child in encouraging the child to eat. The tray apparatus simply holds food and a beverage container. Two different embodiments are illustrated, a boat and a cottage. The apparatus is adapted to be disposed on a table, or the like. There is no provision for holding the apparatus in one hand of a user.

U.S. Pat. No. 3,941,286 (Perkinson) discloses a serving tray having a handle portion at one end of the tray. The handle portion includes an opening through which part of the user's hand extends for holding or supporting the tray. The handle is not designed to be grasped by a user's hand, but rather is designed to be a support portion that is disposed against a user's wrist or forearm for appropriate support.

U.S. Pat. No. 3,964,629 (McCabe) discloses a tray which supports a decanter and a plurality of cups disposed about the decanter. The tray includes a flat platform supported by legs, and appropriate apertures extending through the tray. The peripheral apertures for holding the cups are disposed adjacent to the legs, and the bottoms of the legs turn inwardly for supporting the bottoms of the cups. Similarly, there are downwardly extending "legs" with inwardly extending bottom flanges about the decanter holding aperture in the center of the tray so that the decanter is also supported upwardly from the surface on which the various legs rest.

U.S. Pat. No. 4,534,474 (Ng) discloses a utensil holder which includes three separate annular sections which are concentrically and coaxially aligned with each other. The elements lock together in a stacked relationship. The three elements each have different diameters, and the bottom of each element fits into an associated holding structure of the element beneath it.

U.S. Pat. No. 4,607,758 (Stevens), which incidentally, has the same design as included in the '957 design patent above, is a two-compartment tray separated by a hand hold portion. The hand hold portion includes a slot for receiving the user's thumb. The smaller of the two compartments includes a slot for receiving the stem of glassware.

U.S. Pat. No. 4,785,959 (Kleiner) discloses a combination of cup and plate holder. The apparatus is designed to be carried in or by a single hand, but there is no discussion in the specification as to how the apparatus is to be held. The apparatus essentially includes a flat, plate holding portion and a beverage holding portion. The bottom of the beverage holding portion is a continuation of the plate holding portion with walls extending vertically upwardly to hold a cup. The plate holding portion folds for storage purposes. Included in the apparatus is a clamp which may be moved vertically upwardly or downwardly, as desired, to hold an outer flange or edge of a plate so that the plate may be cantilevered outwardly from, but secured to, the plate holding portion.

British Pat. No. 1252761 (Deeley) discloses a lazy susan type apparatus in which there is a base element which holds a large tray rotatable on the base element. In turn, a plurality of relatively smaller dishes may be disposed in the circular dish.

SUMMARY OF THE INVENTION

The invention described and claimed herein comprises base tray apparatus having a pair of compartments separated by a hand hold compartment. Each compartment receives additional tray elements, depending on the type of food being served. The tray elements include locking structures to secure the tray elements to the base tray.

Among the objects of the present invention are the following:

To provide new and useful tray apparatus;

To provide new and useful serving tray apparatus having a plurality of compartments;

To provide new and useful tray apparatus having interlocking elements;

To provide new and useful tray apparatus including a base tray having compartments for receiving additional tray elements;

To provide new and useful tray apparatus including multiple components which lock together; and To provide new and useful tray apparatus having a base tray and selectable tray elements lockable to the base tray.

BRIEF DESCRIPTION OF THE DRAWING

FIG. 1 is a perspective view of the apparatus of the present invention.

FIG. 2 is a view in partial section taken generally along line 2—2 of FIG. 1.

FIG. 3 is a view in partial section taken generally along line 3—3 of FIG. 1.

FIG. 4 is a view in partial section taken generally along line 4—4 of FIG. 1.

FIG. 7 is a bottom view of the apparatus of FIG. 6.

DESCRIPTION OF THE PREFERRED EMBODIMENT

Figure 5:
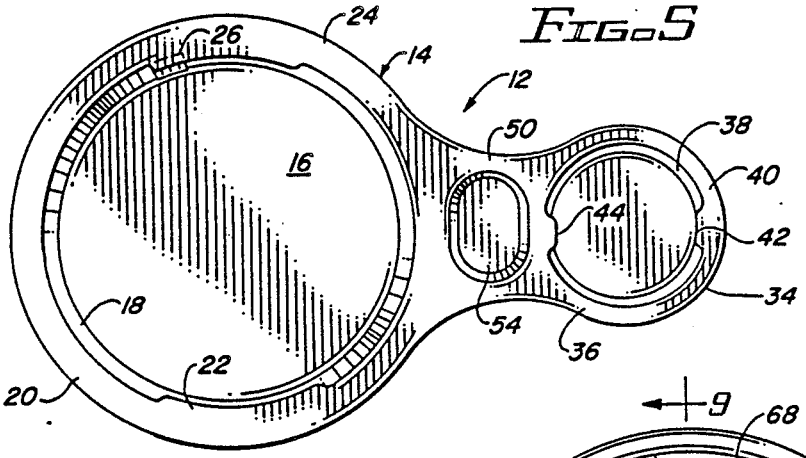
FIG. 5 is a top view of a portion of the apparatus of the present invention.

The apparatus of the present invention comprises tray apparatus 10. The tray apparatus 10 shown in FIG. 1 includes three primary elements, a base tray element 12, a bowl insert element 60, and a cup element 100. FIG. 1 is a perspective view of tray apparatus 10 showing the base element 12, with the bowl insert 60 and the cup element 100 spaced apart from the base element 12.

FIG. 2 is a view in partial section taken generally along line 2—2 of the bowl element 60 of FIG. 1.

It will be noted that line 2—2 of FIG. 1 is a view through what may be referred to as the longitudinal axis of the bowl insert 60. However, as shown in FIG. 2, when the bowl insert 60 is disposed on and secured to the base element 12, the bowl insert element 60 is not aligned with what may be referred to as the longitudinal axis of the base element 12. Rather, the longitudinal axis of the bowl element 60 is offset a substantial amount from the longitudinal axis of the base element 12. This will be discussed in detail below, and the reasons for the offset will be set out in detail also. As far as the base tray element 12 is concerned, FIG. 2 is an oblique or skewed view of the base element 12 because the bowl element 60 is shown in partial section along its longitudinal axis.

FIG. 3 is a view in partial section of a portion of the base element 12 and the bowl insert element 60, taken generally along line 3—3 of FIG. 1, illustrating the interlock between the two elements. FIG. 4 is a view in partial section of a portion of the base element 12 and the cup element 100 secured together, and taken generally along line 4—4 of FIG. 1.

Figure 6:
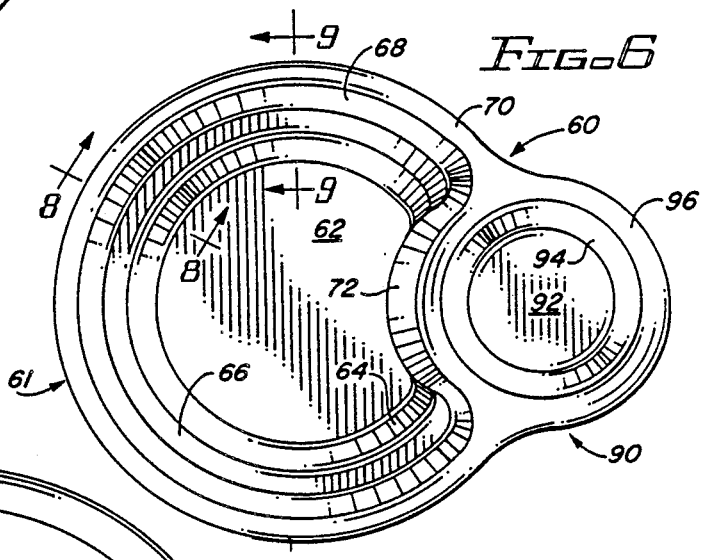
FIG. 6 is a top view of another portion of the apparatus of the present invention.

FIG. 5 is a top view of the base element 12. FIG. 6 is a top view of the bowl insert element 60. FIG. 7 is a bottom view of bowl insert element 60.

Figure 8:
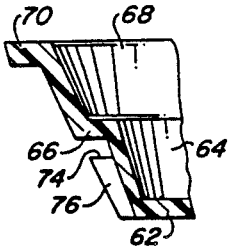
FIG. 8 is a view in partial section taken generally along line 8—8 of FIG. 6.
Figure 9:
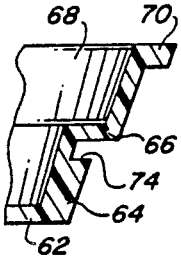
FIG. 9 is a view in partial section taken generally along line 9—9 of FIG. 6.

FIGS. 8 and 9 are views in partial section through the bowl element 60 taken generally along lines 8—8 and 9—9, respectively, of FIG. 6. FIGS. 8 and 9 illustrate the side configuration of the bowl element 60, and particularly the locking features of the bowl element 60 which provide the interlock of the bowl element 60 to the base element or base tray 12. For the following discussion, reference will be made to FIGS. 1-9.

The base tray element 12 includes two portions, a bowl portion 14 and a cup portion 34. The plate portion 14 is connected to the cup portion 34 by an integral connecting rim web 50 and a connecting wide wall web 52. A thumb depression extends downwardly between the plate portion 14 and the cup portion 34 in the connecting rim web 50.

As best shown in FIGS. 1 and 5, and as also shown in FIG. 2, the plate portion 14 includes a generally flat bottom 16. Extending upwardly and slightly outwardly from the bottom portion 16, is a generally circular side wall 18. Extending outwardly from the circular side wall 18 is an outwardly extending rim 20. Extending inwardly from the rim 20, and extending over a portion of the outer peripheral area of the bottom 16 are two locking tabs 22 and 24. The tabs 22 and 24 extend each for an arcuate distance of about thirty degrees. A limit or stop block 26 extends downwardly from one end of the tab 24. The limit or stop block 26 cooperates with the bowl insert 60, as will be discussed below.

It will be noted that the bottom portion 16 is generally circular, as well as generally flat. The base element 12 may be used as a tray by itself, without any additional elements, as desired. In such cases, food may be placed on the bottom 16.

The cup portion 34 includes a generally flat and generally circular bottom portion 36. The bottom 36 is aligned with the bottom 16 when the base element is disposed on a generally flat surface.

An upwardly and outwardly extending side wall 38 is connected to the bottom 36. About the upper portion of the side wall 38, and extending radially outwardly therefrom, is a rim 40. Extending inwardly from the rim 40 are two locking tabs, a tab 42 and a tab 44. The tabs 42 and 44 also extend an arcuate distance of about thirty degrees. As shown in FIGS. 1 and 5, the tabs 42 and 44 are generally symmetrical with respect to the longitudinal axis of the base 12. The tabs 22 and 24 are aligned generally perpendicularly to the longitudinal axis of the base element 12. Accordingly, the tabs 22, 24, and 42, 44 are generally aligned perpendicularly to each other.

The connecting rim web 50 comprise a continuation of the rims 20 and 40 for purposes of securing the base element 12 and the cup element 34 together. The connecting side wall web 52 extends inwardly and downwardly from the rim 50 and is joined to the circular side wall 18 of the plate portion 14 and to the side wall 38 of the cup portion 34. The connecting rim web 50 and the connecting side wall web 52 provide strength and stiffening for the base element 12 and accordingly for the apparatus 10.

The thumb depression 54 extends downwardly through the connecting rim web 50 about half way between the plate portion 14 and the cup portion 34. The thumb depression 54 comprises a convenient location for placing or receiving the thumb of a user of the tray apparatus 12, as when the apparatus 12 is used by itself or when the base element 12 is used in conjunction with the bowl insert 60 or with a dinner plate element 120, as will be discussed in detail below.

The bowl insert 60 is adapted to be disposed on the base element 12 by placing the bowl insert 60 on the plate portion 14 and by slightly rotating the bowl insert 60 to lock the bowl insert 60 to the plate portion 18 of the base element 12.

The bowl insert 60 includes two primary portions, a plate portion 61 and a salad or dip cup portion 90. The plate portion 61 includes a bottom portion 62 which is generally flat or planar, and which is disposed against the bottom 16 when the bowl insert 60 is secured to the base tray element 12. This is shown in FIG. 2. Extending upwardly and outwardly from the bottom 62 is a bottom wall 64.

Extending radially outwardly from the top of the bottom wall 64 is a flange 66. The flange 66. The flange 66 comprises a generally outwardly extending extension of the bottom wall 64, or a transition between the bottom wall 64 and an upper wall 68. The upper wall 68 extends generally upwardly and outwardly from the flange 66. The upper wall 68 terminates in an outwardly extending rim flange 70. The extent of the circular bottom 62 of the bowl insert 60 is for an arcuate distance of about three hundred degrees, or about one-hundred fifty degrees on opposite sides of the longitudinal axis of the bowl insert 60 remote from an integral salad or dip cup 90.

For an arcuate distance of about sixty degrees, there is a relatively smooth and continuous interior wall 72 which is generally concave with respect to the bottom 62 and the walls 64 and 68. The interior wall 72 extends from the bottom 62 to the rim flange 70. The bottom wall 64, the flange 66, and the upper wall 68 all blend into the wall 72. The wall 72 is generally symmetrical to the longitudinal axis of the insert 60.

The rim flange 70 extends to a salad or dip cup rim flange 96 of the salad or dip cup 90. The salad or dip cup 90 includes a generally flat bottom 92. The bottom 92 is generally circular. Extending upwardly and slightly outwardly from the bottom 92 is a sloping wall 94. The sloping wall 94 extends from the bottom 92 to the rim flange 96.

As best shown in FIG. 2, the depth of the salad or dip cup portion 90 is less than the depth of the plate portion 61 of the insert 60.

As again best shown in FIG. 2, when the insert 60 is disposed on the base element 12, the salad or dip cup portion 90 is disposed on the rim portions 40 and/or 50 of the base element 12, depending on the particular orientation of the insert 60 with respect to the base tray element 12.

As best shown in FIGS. 3, 7, 8, and 9, the lower side wall 64 of the bowl portion 61 of the insert 60 is thickened in some places. A groove 74 extends into the lower bottom wall 64 from beneath the flange 66. The groove 74 cooperates with the flanges 22 and 24 to lock the insert 60 to the base element 12. As best shown in FIG. 7, there are two gaps in the side wall 64. The gaps extend about, or slightly greater than, thirty degrees on opposite sides of the longitudinal axis of the insert 60. One gap, the "outer" gap, or the gap remote from the cup portion 90, includes a face 76 and a face 78. The face 76 is also shown in FIG. 8. The space or gap diametrically opposite the outer gap is defined by the juncture of the wall 64 of the plate portion 61 and the smooth sloping inner wall 72.

The gaps in the wall cooperate with the flanges 22 and 24 to allow the insert 60 to be disposed on and locked to the base 12.

It will be noted that the stop element 26 is located at one end of the tab 24. Accordingly, when the insert 60 is oriented properly with the gaps in the side wall 66 placed over the tabs 24 and 26, the insert 60 may be rotated only a relatively short distance before the face 76 or 78, or the bottom wall 64 at the ends of the sloping wall 72, contacts the stop element 26. However, the distance that the insert 60 rotates is sufficient to cause the tabs 22 and 24 to extend into the groove 74 to lock the insert 60 to the base 12.

It will be noted that the insert 60 may be oriented in several ways. The apparatus 10 accordingly may be used by a right-handed person or a left-handed person, as desired. In FIG. 2, the orientation of the insert 60 is a typical orientation for a right-handed person. A right-handed person would generally hold the tray apparatus 10 in the user's left hand, with the user's left thumb in the depression 54, and with the fingers of the left hand disposed beneath the connecting web 52, or the like. However, for a left-handed user, the insert 60 would be rotated to the opposite side of the base 12. Under such circumstances, the cup portion 90 is disposed conveniently for access to a user's left hand, but still balanced on the rim 40 and/or the rim 50, but opposite that shown in FIG. 2. That is, the salad or dip cup portion 90 is disposed on the rims 40 and/or 50 on the opposite side of a longitudinal axis of the base 12 from that illustrated in FIG. 2.

It will be understood that the orientation of the salad or dip cup 90 on the rims 40 and/or 50 is to help support the salad or dip cup 90. Accordingly, the bottom 92 of the salad or dip cup 90 is at about the same height as the flange 66, as shown in FIG. 2.

The cup portion 34 of the base element 12 is adapted to receive a cup 100, shown in FIG. 1 spaced apart from the cup portion 34. The cup 100 includes a generally cylindrical container wall 102 closed by a bottom 104. The bottom 104 is shown in FIG. 4.

At the top of the container 102 is a handle 106. The handle extends outwardly from the wall 102. The container wall 102 may extend upwardly and slightly outwardly from the bottom 104, if desired.

Extending outwardly from the container wall 102 and slightly above the bottom 104, and appropriately dimensioned to fit beneath the inwardly extending tabs 42 and 44 of the cup portion 34, are two locking ridges 108 and 110. In FIG. 4, the ridge 108 is shown disposed beneath the tab 44.

The ridges or flanges 108 and 110 extend generally circumferentially for a distance of slightly less than one hundred twenty degrees each. Between their ends are gaps of slightly more than sixty degrees. The gaps allow the cup 100 to be inserted into the cup portion 34 of the base 12, with the gaps between the ridges moving downwardly past the locking tabs 42 and 44.

Essentially the same inserting and locking system is used with the cup 100 that is used with the insert 60. With the base element 12 including the locking tabs, the insert 60 and the cup 100 include openings or gaps to allow them to extend into the base element. The elements 60 and 100 then rotate to lock the insert 60 and cup element 100 in their respective plate and cup portions 14 and 34, respectively.

Figure 10:
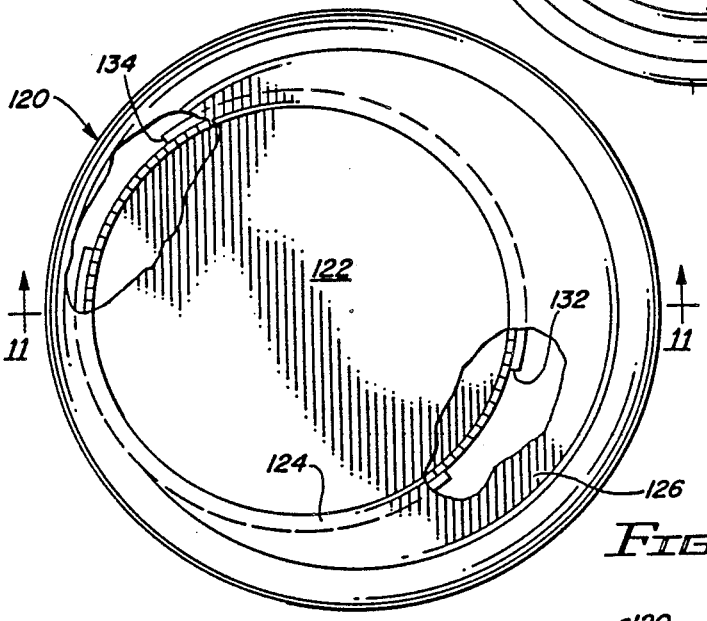
FIG. 10 is a top view of an alternate embodiment of a portion of the apparatus of the present invention.

FIG. 10 is a top view of a dinner plate insert 120 which may be used in place of the insert 60 with the base element 14. The dinner plate insert 120 has a substantially larger surface area for receiving food than does the insert 60, and particularly the plate portion 61 of the insert 60. However, due to the dimensions of the base 12, the dinner plate insert 120 includes an eccentric or offset plate base to allow the insert 120 to be secured to the base 12. The plate insert 120 is the fourth element of the tray apparatus 10.

The dinner plate insert 120 includes a generally circular base 122. A relatively short upwardly extending wall 124 is secured to the base 122. An eccentric offset plate portion 126 extends outwardly from the top of the short wall 124. The plate base 126 is eccentrically disposed with respect to the circular base 122, as discussed above, as shown in FIG. 10. An outer wall 128 extends generally upwardly from the periphery of the plate portion 126.

The base 122 extends outwardly beyond the short, inner wall 124 to define a locking groove 130 beneath the upper bottom or upper plate portion 126, above the base 122, and outwardly from the wall 124. The portion of the base 122 within the inner wall 124 comprises a lower bottom or lower plate portion for the insert 120.

The locking groove 130 cooperates with the tabs 22 and 24 of the base 12 to secure the insert 120 to the base element 12.

To allow the insert 120 to be placed appropriately on the base element 12, there are a pair of gaps in the generally circular base 122. A gap 132 and a gap 134 are shown in the broken away portions of FIG. 10. As has been discussed, the tabs 22 and 24 extend arcuately a distance of about sixty degrees, and accordingly the two gaps 132 and 134 on the base 122. Each extend an arcuate distance of slightly greater or more than sixty degrees.

As may best be understood from FIG. 10, the geometry of the eccentric plate 126 with respect to the base 122, and the gaps 132 and 134 are appropriately configured or placed to provide the proper orientation of the insert 120 on the base 12. There is preferably only a single orientation of the dinner plate insert 120 on the base 12, and that is with the widest part of the plate base 126 remote from the connecting portion between the plate portion 14 and the cup receptacle portion 34. That is, the widest portion of the insert 120 between the base 122 and the outer wall 128, or the widest portion of the eccentric base 126, will be disposed remotely from the connecting rim web 50 and its thumb depression 54 when the plate insert 130 is disposed on the base 12.

The apparatus 10, as discussed above, comprises a versatile tray and accessory package designed for buffet type eating, where a user will not be sitting at a table, but rather will be eating either standing up or sitting at other than a table. For some occasions, only the base element, with its relatively small plate portion 14, may be used. For example, a piece of cake, pie, or the like may be conveniently disposed on the plate portion 14, and a cup of punch, or the like, may be conveniently disposed in a cup element 100 and inserted into the cup portion 34 of the base 12.

If a larger food area is desired, such as when there are different types of foods, the insert 60 may be used. With the insert 60, there is a plate portion 61 which may be used for receiving salads or the like, or an entree, and a salad, or a vegetable, may be disposed in the salad or dip cup portion 90. The cup portion 34 of the base 12 is still usable with the insert 60, although the salad or dip cup portion 90 is disposed on the rim 50 for support.

Finally, if a larger food receiving element is desired, the dinner plate insert 120 may be used with the base 12. Obviously, the cup portion 34 is still available when the dinner plate insert 120 is used.

When the tray apparatus 10 is used for a three course meal, the base 12 is used with the insert 60 for the salad course, or for chips and dip, if preferred. The salad or chips are disposed in the plate portion 61 and the dip, or Jello, etc., may be disposed in the cup portion 90. The cup holder 34 is available to receive a beverage container, if desired.

For the main course, the dinner plate insert 120 is used. The dinner plate element 120 is secured to the base element 12. The cup holder 34 receives a beverage container or holder.

For the dessert course, the base tray element 12 is used by itself. The cup holder 34 is, of course, still available for a beverage container or holder.

It will be noted that food has been referred to in very general terms. Obviously, virtually any or all types of food material may be used, including soups, if desired. The insert elements 60, 110, and 120 may be configured as desired to hold any desired material. The sides of the base tray 12 and the insert elements may be of any desired height to hold soups, fruit, various types of salads, or other food material, etc. The container 100 may be configured as desired to hold various types of liquid materials or even solid materials, either food materials or a beverage can, or other. The tray apparatus 10 may be as flexible and varied as desired.

Figure 12:
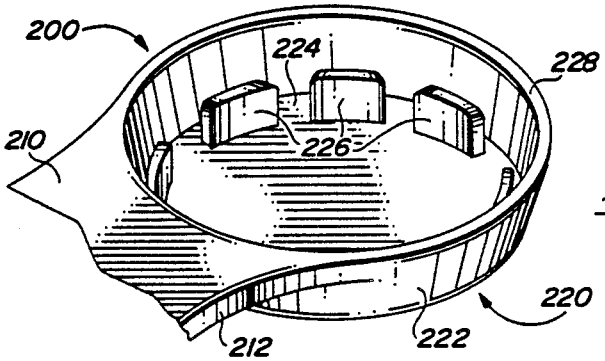
FIG. 12 is a perspective view of a portion of an alternate embodiment of the apparatus of the present invention.

FIG. 12 is a perspective view of a portion of a base tray element 200 which includes an alternate embodiment cup receiving portion 220. The base tray element 200 includes a horizontal connecting web 210 to which the cup receiving portion 220 is secured.

Figure 13:
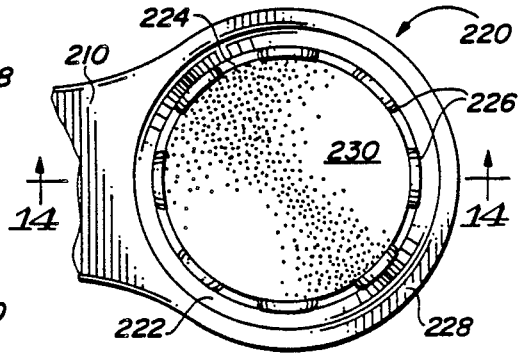
FIG. 13 is a top view of the apparatus of FIG. 12.
Figure 14:
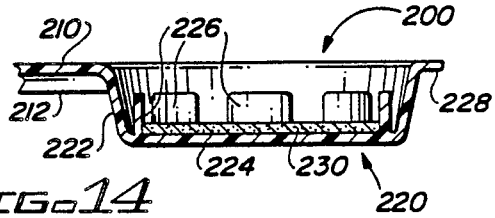
FIG. 14 is a view in partial section taken generally along line 14—14 of FIG. 3.

FIG. 13 is a top view of the cup portion 220, with a portion of the connecting web 210 secured thereto. FIG. 14 is a side view in partial section of the cup portion 220 and the connecting web 210. For the following discussion, reference will primarily be made to FIGS. 12, 13, and 14.

The connecting web 210 extends generally horizontally. It includes a downwardly extending vertical web 212. The cup receiving portion 220 is secured to the connecting web 210. The cup receiving portion 220 includes a side wall 222. The downwardly extending web 212 blends into the side wall 222.

The cup receiving portion 220 includes a bottom 224 at the lower portion of the side wall 222. As best illustrated in FIG. 14, the side wall 222 includes a generally inwardly extending slope or slant from the connecting web 210 to the bottom 224. The bottom 224 is, of course, generally flat and generally parallel to the web 210.

Extending upwardly from the bottom 224 is a plurality of spaced apart and generally vertically extending flanges or tabs 226. The flanges or tabs 226 are spaced apart from each other in a generally circular configuration, as best shown in FIG. 13. The flanges or tabs 226 are of a generally uniform height, and they are disposed a relatively short distance radially inwardly from the wall 222. They cooperate with base elements or utensils, such as cup utensils or elements illustrated in FIGS. 16, 17, and specifically as shown in FIG. 18, for supporting and securing cup elements to the cup portion 220.

A horizontal flange 228 extends outwardly from the upper portion of the cup portion 220. The horizontally outwardly extending flange 228 is generally a continuation of the connecting web 210 which extends about the periphery of the side wall 222.

A protective pad or absorbent pad 230 is shown disposed on the bottom 224 and within the circular area defined by the flanges 226.

Figure 15:
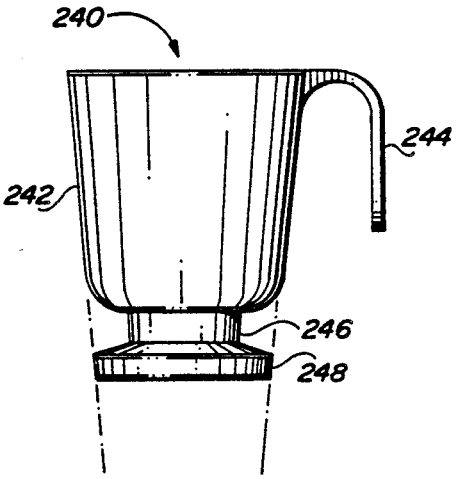
FIG. 15 is a side view in partial section of a utensil usable with the apparatus of FIGS. 12, 13, and 14.
Figure 17:
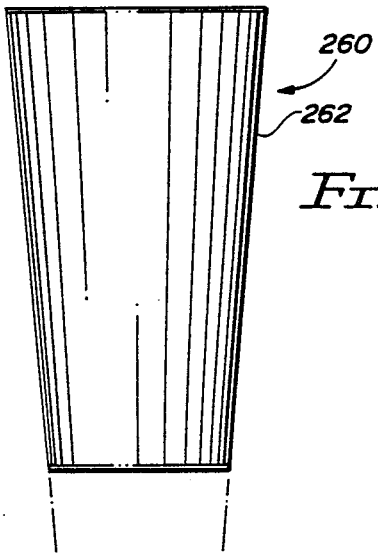
FIG. 17 is a side view of another alternate utensil usable with the apparatus of the present invention.
Figure 16:
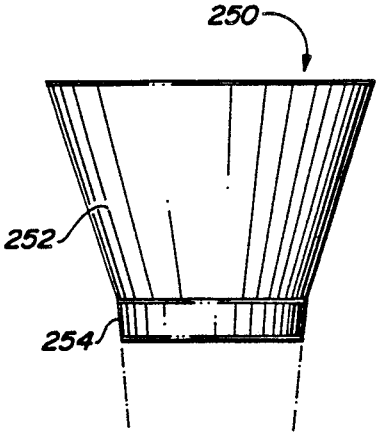
FIG. 16 is a side view of an alternate utensil usable with the apparatus of FIGS. 12, 13, and 14.
Figure 18:
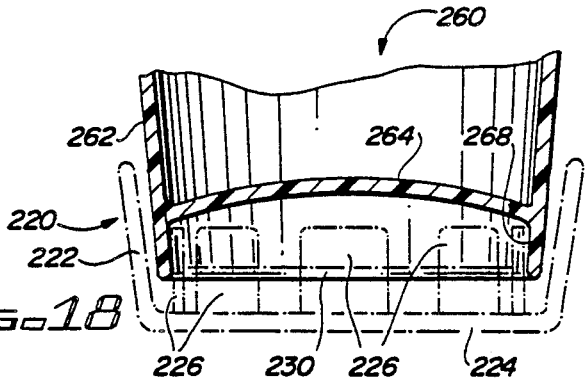
FIG. 18 is a side view in partial section illustrating a common base for the utensils illustrated in FIGS. 15, 16, and 17.

FIGS. 15, 16, and 17 illustrate different configurations of utensils, namely cup elements, which may be inserted or used with the cup portion 220 of the tray apparatus 200. FIG. 15 discloses a cup 240 which includes a container portion 242 and a handle 244 connected to the container portion 242. A support portion or stem portion 246 extends downwardly from the container portion 242. The support or stem portion 246 is in turn secured to a base 248. The base 248 is designed to be inserted about the flanges 226 to secure the cup 240 to the cup portion 220 of the tray apparatus 200.

FIG. 16 is a side view of an alternate cup element 250 also usable with the cup receiving portion 220 of the tray apparatus 200. The cup element 250 includes a container portion 252 and a base portion 254. Again, the base portion 254, like the base portion 248 of the cup apparatus 240, is designed to be used with the flange or tab elements 226 to help secure and support the cup element 250 on the tray apparatus 200 to keep it from tipping, etc., as the tray apparatus 200 is employed by a user. Moreover, the tabs 226 and the base 248 provide a path for any moisture condensing on the sides of the container portion 252 to fall by gravity to the pad 230 for absorption thereby. The moisture may also escape from the pad 230 and the bottom 224 by an evaporation path up the side 222.

FIG. 17 is a side view of another alternate cup element 260. The cup element 260 includes a container wall 262 blending directly into a bottom portion, best illustrated in FIG. 18. FIG. 18 is a view in partial section of the lower portion of the cup element 260, with portions of the cup apparatus 220 shown in phantom.

In FIG. 18, the side wall 262 is shown extending downwardly and terminating in a bottom rim 266. A container bottom 264 is spaced apart upwardly from the bottom rim 266. Between the bottom 264 and the rim 266 is a lower side wall portion 268, which essentially comprises a base, comparable to the base portions 248 and 254 of the cup apparatus 240 and 250 of FIGS. 15 and 16. The base flange 268 is simply a continuation of the container wall 262.

In FIG. 18, the lower part of the cup portion 220 is shown in phantom in relation to the bottom portion of the cup 260. The base flange 268 is disposed outside of the vertical flanges 226. The inner diameter of the base flange portion 268 is about the same as the outer diameter of a circle defined by the outer periphery of the flanges 226. The height of the flange 268, or the distance between the bottom rim 266 and the juncture of the container bottom 264 with the container wall 262 and the base flange 268 is slightly less than the overall height of the flanges or tabs 226. Accordingly, there is a space between the inner portion of the bottom 224 and the rim 266 of the cup 260. Similarly, there is a slight space between the wall 222 of the cup portion 220 and the walls 262 and 268 of the cup 260. This allows any moisture condensing on the outer wall 262 of the cup 260 to move downwardly, as by gravity, and be collected on the bottom 224 of the cup portion 222. At the same time, the moisture is free to evaporate from the cup portion 220, as various conditions allow.

From FIG. 18, it will be obvious that the general design of the cup element is relatively important, and that only the bottom portion is of concern with respect to the apparatus of the present invention. That is, the base flange involved in supporting a cup element in the cup portion 220 should preferably be such that the flanges 226 will hold the utensil or cup slightly above the bottom 224 to allow for condensation to migrate into the bottom where it is either absorbed, as by the cushion 230, or where the moisture may evaporate, depending on atmospheric conditions. At the same time, the cup element will be securely held by the flanges providing, of course, that the container utensil or cup has a base with the appropriate diametric dimensions.

If desired or if deemed advantageous, it is obvious that the flanges or tabs 226 may have a slight taper slope to them for providing a positive bias against the base portion of a cup element. Similarly, a base portion of a cup element may include a slight taper or slope so as to cooperate with the flanges or tabs 226 to provide a locking bias for securing the cup element to the cup receiving portion 220. However, the locking bias should not be so tight as to require removal force by a user that may result in a jerky movement of the cup element that may result in either or both a spill of the cup element or of the tray portion (not specifically shown) of the tray apparatus 200.

Figure 11:
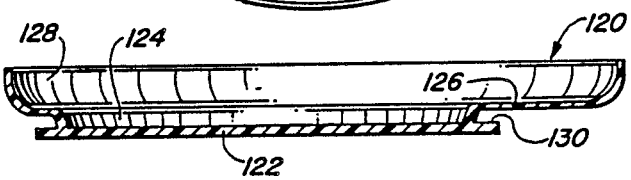
FIG. 11 is a view in partial section taken generally along line 11—11 of FIG. 10.

Moreover, it will be noted that the term "cup" or "cup element" may also include a bowl or the like. With a bowl utensil or element, depending on its relative size, its base portion which cooperates with the tabs or flanges 226 may be symmetrical, as with the cup elements 240, 250, and 260, or offset, as generally shown for the plate 120 in FIGS. 10 and 11.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What I claim is:

1. Tray apparatus, comprising, in combination:
- a base tray, including
  - a first portion having
    - a bottom,
    - a side wall secured to the bottom and extending generally upwardly therefrom,
    - a rim secured to the side wall and extending generally outwardly therefrom remote from the bottom, and
    - tab means extending inwardly from the side wall at the rim and comprising cooperative locking means for securing a plate insert to the base tray;
- a cup portion, including
  - a bottom,
  - a side wall secured to the bottom and extending generally upwardly therefrom,
  - a rim secured to the side wall and extending generally outwardly therefrom remote from the bottom, and
  - tab means extending inwardly from the side wall at the rim and comprising cooperative locking means for securing a cup insert to the cup portion of the base tray;
- connecting means for spacing apart and connecting together the first plate portion and the cup portion and comprising a hand hold portion adapted to be grasped by a user's hand for holding the tray apparatus; and
- insert means securable to the base tray, including
  - first plate insert means securable to the first plate portion, including
    - a bottom,
    - side wall means extending generally upwardly from the bottom for defining, with the bottom, a food enclosing area, and
    - groove means in the side wall means for receiving the tab means of the base tray to lock the first plate insert means to the base tray as the first plate insert means is rotated relative to the base tray.

2. The apparatus of claim 1 in which the side wall means includes gap means adjacent to the groove means for receiving the tab means as the first plate insert means is secured to the base tray.

3. The apparatus of claim 2 in which the tab means includes a limit block for limiting the rotational movement of the first plate insert means relative to the base tray.

4. The apparatus of claim 3 in which the first plate insert means further includes a cup portion disposed on the rim of the first plate portion when the first plate insert means is secured to the base tray.

5. The apparatus of claim 4 in which the cup portion of the first plate insert means includes a bottom, a side wall secured to the bottom and extending generally upwardly therefrom, and a rim secured to and extending generally outwardly from the side wall, and the bottom is disposed on the rim of the first plate portion when the first plate insert means is secured to the base tray.

6. The apparatus of claim 1 which further includes second plate insert means securable to the first plate portion.

7. The apparatus of claim 6 in which the second plate insert means includes
- a base, an inner wall extending generally upwardly from the base, and a plate portion extending generally outwardly from the inner wall and eccentrically disposed with respect to the base.

8. The apparatus of claim 7 in which the second plate insert means further includes locking means for securing the second plate insert means to the first plate portion of the base tray.

9. The apparatus of claim 8 in which the means for securing the second plate insert means to the first plate portion of the base tray includes groove means cooperating with the tab means to provide a locking engagement.

10. The apparatus of claim 9 in which the groove means includes a groove between the base and the plate portion outwardly from the inner wall.

11. The apparatus of claim 10 in which the groove means further includes gap means to receive the tab means.

12. The apparatus of claim 1 which further includes a cup insert adapted to extend into the cup portion.

13. The apparatus of claim 12 in which the cup insert includes ridge means cooperating with the tab means of the cup portion for securing the cup insert to the cup portion.

14. Tray apparatus for selectively receiving material, including food, or insert elements, comprising, in combination:

plate means for selectively receiving material, including food, or an insert element;

locking means for securing an insert element to the plate means;

cup means for selectively receiving food or a container element spaced apart from the plate means;

insert element means including an insert element selectively securable to the plate means for receiving material; and connecting means for connecting together the plate means and the cup means and adapted to be grasped by a user's hand for holding the tray apparatus.

15. The apparatus of claim 14 in which the insert element of the insert element means includes a plate insert element securable to the plate means for receiving food.

16. The apparatus of claim 15 in which the insert element of the insert element means further includes a salad cup portion secured to the plate insert element.

17. The apparatus of claim 15 in which the insert element of the insert element means includes a dinner plate insert element securable to the plate means and having a base portion and an offset plate portion eccentrically disposed relative to the base portion.

18. The apparatus of claim 14 in which the insert element means includes container means insertable into the cup means.

19. The apparatus of claim 18 in which the cup means includes a cup and first lock means and the container means includes a container and second lock means cooperating with the first lock means for securing the container to the cup.

20. The apparatus of claim 14 in which the locking means includes first locking means secured to the plate means and second locking means secured to the insert element means cooperating with the first locking means for securing the insert element to the plate means.

21. Tray apparatus, comprising, in combination:

plate means for receiving material, including a first portion for receiving food items, a second portion for selectively receiving food items or a cup, first locking means for securing the cup to the second portion, and a connecting portion for spacing apart and connecting the first and second portions and comprising a holding portion for a user's hand; and cup means securable to the second portion of the plate means, including a cup, and second locking means for engaging the first locking means for securing the cup to the second portion.

22. The apparatus of claim 21 in which the first locking means includes tabs, and the second locking means includes ridges cooperating with the tabs for securing the cup to the second portion.

23. The apparatus of claim 21 in which the second portion of the plate means includes a flat portion, a wall extending upwardly from the first portion, and the first locking means extends inwardly from the wall portion.

24. The apparatus of claim 23 in which the cup means includes a bottom, a container wall extending upwardly from the bottom, and the second locking means extends outwardly from the container wall.

25. Tray apparatus, comprising, in combination:

plate means for receiving material, including a first portion for receiving food items, a second portion for receiving a cup element, means for securing the cup element to the second portion, and a connecting portion for spacing apart and connecting the first and second portions and comprising a holding portion for a user's hand; and cup element means securable to the second portion of the plate means, including a cup element, and locking means on the cup element for engaging the means for securing the cup to the second portion.

26. The apparatus of claim 25 in which the means for securing the cup element to the second portion includes a generally vertically extending element for engaging the locking means on the cup element.

27. The apparatus of claim 26 in which the locking means on the cup element includes a base flange for engaging the generally vertically extending element.

28. The apparatus of claim 25 in which the second portion includes a bottom and the means for securing the cup element to the second portion includes a plurality of tabs secured to the bottom and extending generally vertically upwardly from the bottom.

29. The apparatus of claim 28 in which the locking means on the cup element includes a bottom and a base flange extending generally downwardly from the bottom, and the plurality of tabs contacts the cup element bottom and the base flange.

30. The apparatus of claim 29 in which the base flange includes a bottom rim, and the bottom rim is spaced apart above the second portion bottom when the cup element means is secured to the second portion of the plate means.

* * * * *